US006447363B1

(12) United States Patent
Carraway

(10) Patent No.: US 6,447,363 B1
(45) Date of Patent: Sep. 10, 2002

(54) METHOD OF CONVEYING AN INTERCESSORY PRAYER PLEDGE

(76) Inventor: Teresa L. Carraway, 5910 Valley Estates Dr., Raleigh, NC (US) 27612

( * ) Notice: Subject to any disclaimer, the term of this patent is extended or adjusted under 35 U.S.C. 154(b) by 203 days.

(21) Appl. No.: 09/079,293

(22) Filed: May 12, 1998

(51) Int. Cl.[7] ..... A63H 3/00

(52) U.S. Cl. ..... 446/268; 434/245; 434/414; 446/71; 446/72

(58) Field of Search ..... 446/268, 319, 446/98, 390, 302, 321, 219, 297, 71, 72, 73, 74; 428/3; 434/155, 236, 245, 414

(56) References Cited

U.S. PATENT DOCUMENTS

| | | | | | |
|---|---|---|---|---|---|
| 4,358,013 | A | | 11/1982 | Shebley | |
| 4,509,280 | A | | 4/1985 | Smith | |
| 4,795,397 | A | * | 1/1989 | Stevens | 446/369 X |
| 4,878,871 | A | | 11/1989 | Noto | |
| 5,046,985 | A | | 9/1991 | Cearfoss | |
| 5,059,149 | A | | 10/1991 | Stone | |
| 5,094,621 | A | | 3/1992 | Friedel | |
| 5,184,958 | A | * | 2/1993 | Ward et al. | 446/268 X |
| 5,324,201 | A | | 6/1994 | Friedel | |
| 5,588,895 | A | * | 12/1996 | Lardon | 446/98 |
| 5,607,337 | A | | 3/1997 | Callahan | |
| 5,807,155 | A | * | 9/1998 | Divvleeon | 446/369 X |

* cited by examiner

*Primary Examiner*—Derris H. Banks
*Assistant Examiner*—Dmitry Suhol
(74) *Attorney, Agent, or Firm*—Mills Law Firm PLLC

(57) ABSTRACT

A method and apparatus for providing tangible evidence of intercessory prayers offered on behalf of a recipient is disclosed. A soft sculpture in the form of a doll or stuffed animal and being comprised of a fabric material suitable for the application of handwritten signatures by a writing implement is utilized to perform the method of the present invention. The method of the present invention includes the steps of fabricating the soft sculpture doll with the attached writing implement, circulating the soft sculpture doll among a plurality of persons who have pledged to remember the recipient in their personal prayers, and delivering the soft sculpture with an attached prayer inscription to the recipient.

1 Claim, 1 Drawing Sheet

METHOD OF CONVEYING AN INTERCESSORY PRAYER PLEDGE

BACKGROUND OF INVENTION

1. Field of Invention

Figure 1:
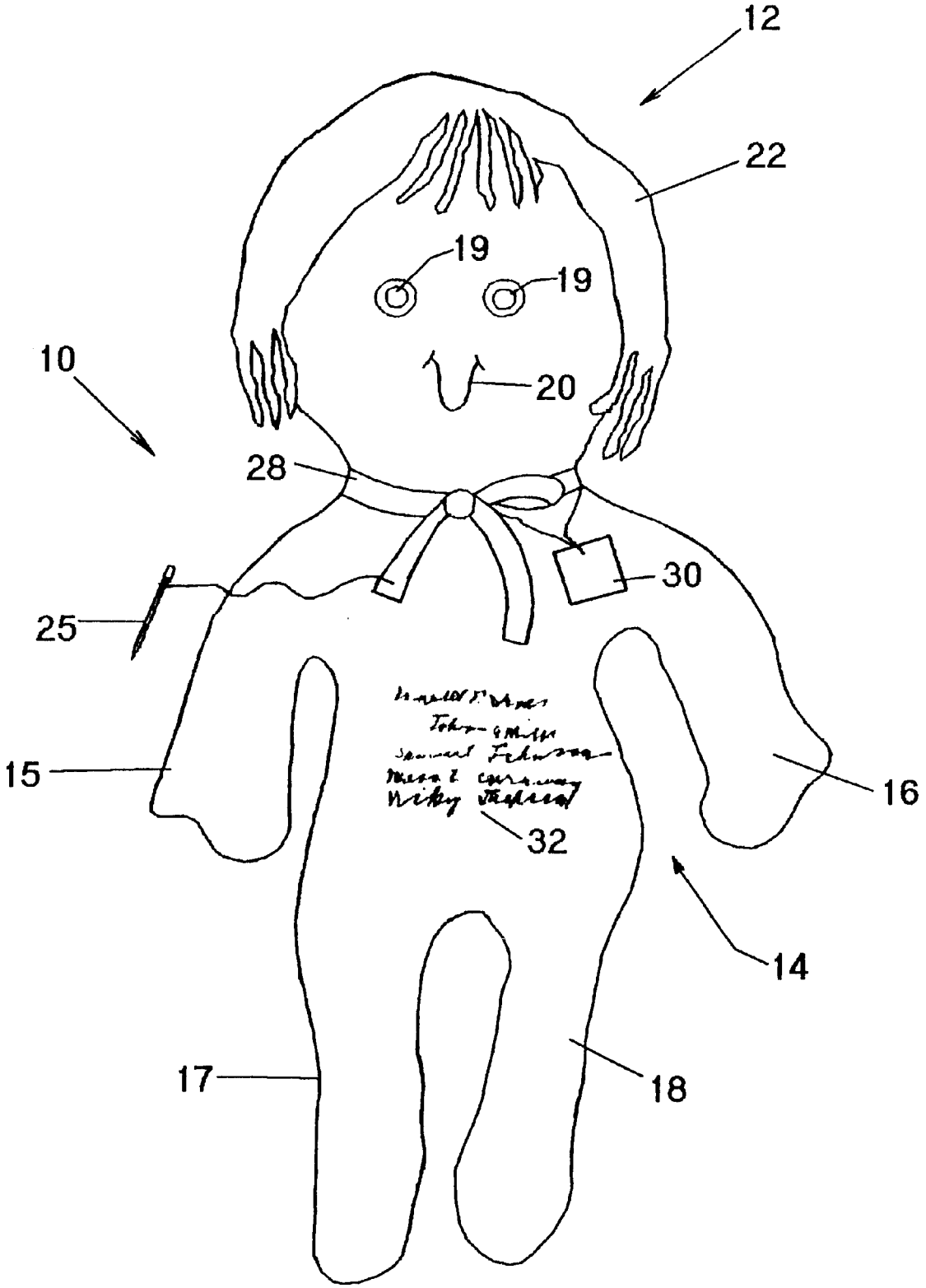

This invention relates to a method of preparing and conveying an intercessory prayer pledge and to a soft sculpture which is utilized in performing the method.

It is the common practice of many people to recite prayers for family members friends and/or who may be suffering from an illness or undergoing other crises. In addition, prayers may be offered to share in other's celebrations i.e. birth of a child.

It is desirable to communicate such personal prayers to the recipient thereby enhancing their spiritual well being.

Thus, the present invention has been developed to provide a method for conveying such personal prayer messages and to provide a soft sculpture which is useful in performing the method.

2. Description of Related Prior Art

U.S. Pat. No. 5,607,337 to Glenda C. Callahan discloses a system for memorializing the birth of an infant comprising a marking medium and a soft sculpture. The marking medium is appliable to the palms and soles of the infant's hands and feet and is used to replicate the epidermal pattern of the infant's hands and feet upon a substrate.

U.S. Pat. No. 4,878,871 to Nancy C. Noto discloses a method of preparing and conveying a personalized message from a sender to a recipient utilizing a toy having a cavity containing a cassette player, a battery holder, switch and circuit elements interconnecting the player, the holder and the switch. This method includes the following steps which are performed by the sender; personally taping the personalized message on the cassette; inserting the cassette in the player; and giving the toy to the recipient with the cassette therein.

U.S. Pat. No. 5,059,149 to Timothy J. Stone discloses a stuffed animal apparatus including one or more storage compartments in which visual and/or audio materials may be stored and/or displayed. The storage compartments are disposed in the stuffed animal body or in an appendage.

U.S. Pat. No. 5,046,985 to Roscoe Cearfoss discloses a doll having a permanently imprinted doll face on a flap overlying a blank face plate. When the flap is in a down position, the doll is played with in a conventional manner. When the flap is raised, the plate is revealed and the child can draw face designs on the plate.

U.S. Pat. No. 5,094,621 to Joan Friedel discloses a therapeutic doll for self-help that can be used outside of a therapeutic of self-help session. The doll includes a heart area which can be illuminated and speech-producing device which outputs encouraging messages. The doll also includes a variety of icons, such as a liquor bottle or pill bottle, which symbolize personal vices.

U.S. Pat. No. 5,324,201 to Joan Friedel discloses a doll including a body having a torso defining a cavity housing a shelf and closed by a door. A user tears a sheet from a note pad, writes a secret upon the sheet, inserts the sheet into a pocket into the star-like body and inserts the latter upon the shelf. The door of the cavity is closed and the star-like body and the secret upon the note is displaced for subsequent reuse. The secret can also be written upon the sheet torn from the note pad using a pen with conventional disappearing ink.

U.S. Pat. No. 4,358,013 to David P. Shebley discloses a meditation supporting device including a variety of religious or inspirational messages as indicia upon scrolls which are separately inserted in capsule-like containers, a plurality of the capsule-like containers with a variety of the messages being disposed within a large display container for selective removal for the purpose of promoting meditation.

Finally, U.S. Pat. No. 4,509,280 to Veronica Smith discloses a greeting and toy device comprising an animal simulating toy including a main body member consisting of a closed flexible soft envelope containing a soft resilient filler puffing the envelope and an animal part simulating section joined to the envelope and swingable between open and closed positions relative to a corresponding surface of the envelope.

SUMMARY OF THE INVENTION

After much study of the above described problem, the present invention has been developed to provide a method for conveying personal prayer pledges to a recipient who may be undergoing an illness or other crises as well as special celebrations.

The primary purpose of the present invention is to provide tangible evidence to the recipient of the intercessory prayers being offered on behalf of the recipient by all of those persons who apply their signature to a soft sculpture in the form of a doll, which is utilized in performing the present method.

Those persons whose signatures appear on the soft-sculpture doll pledge to remember the recipient in their personal prayers. The giving of the soft sculpture doll or Prayer Pal as it has become known is intended to lift the recipient in a spiritual manner thereby delivering strength, hope, and love to the recipient.

In view of the above, it is an object of the present invention to provide a method of conveying personal prayer pledges to friends or family experiencing crises or special celebrations.

Another object of the present invention is to provide a tangible evidence of the intercessory prayers being offered by all persons who place their handwritten signature on the soft sculpture doll utilized to perform the present method.

Another object of the present invention is to provide a soft sculpture doll having an exterior surface constructed of a material on which hand writing may be applied.

Other objects and advantages of the present invention will become apparent and obvious from a study of the following description and the accompanying drawings which are merely illustrative of such invention.

BRIEF DESCRIPTION OF INVENTION

FIG. 1 is a front elevational view of a soft sculpture doll utilized in performing the method of the present invention.

DETAILED DESCRIPTION OF THE PREFERRED EMBODIMENT

With reference to the drawings, there is shown therein a soft sculpture utilized to perform the method of the present invention, indicated generally at 10 and illustrated in FIG. 1. In this embodiment the soft sculpture 10 is in the form of a stylized doll having an interconnected head portion 12 and a torso portion 14 having four appendages 15, 16, 17 and 18. The head portion 12 includes eyes 19, mouth 20 and hair 22.

Although the present embodiment of the soft sculpture is described as a doll, it will be understood that the method of the present invention is equally applicable to other toys such as a stuffed animal (not shown). Thus, the embodiment depicted herein is intended to be merely illustrative and not restrictive in any sense.

The head portion 12, the torso portion 14 and the appendages 15–18 are fabricated from any material suitable for the application of handwritten messages and signatures such as natural and synthetic fabric materials by means of a standard writing implement.

The soft sculpture is fabricated in a conventional manner by using a pattern (not shown) to cut out two sheets of such material along the outer periphery of the pattern and stitching the two sheets together about the other peripheral edges thereof in overlying relation. Thereafter, the two sheets of material are turned inside out and the head, body, and appendages are stuffed with a fiberfill material to form the soft sculpture.

The particular fabric used in the construction of the soft sculpture 10 is not critical except that it be suitable for receiving handwritten markings created by a writing implement 25 such as a ball point pen or a permanent marking pen which is attached to the soft sculpture 10 by a cord 26 for the convenience of the users.

In the alternative the writing implement 25 may be attached about the neck of the soft sculpture with a predetermined length of ribbon 28. A placard or card 30 bearing a prayer description is also attached to the soft sculpture and for the purpose of introduction and description to the recipient.

An exemplary embodiment of a card 30 will bear the following inscription:

I Am Your Prayer Pal

A Gift From Those Who Care

A Little Friend To Remind You

That Your Smiles And Tears Are Shared

And Those Who Sign Upon My Heart Will

Keep You In Their Prayers

"For where two or three come together in my name, there am I with them." Matthew 18:20

In practical use after the soft sculpture 10 has been fabricated as described hereinabove, those persons interested in pledging to remember the recipient in their personal prayers may apply a handwritten message or simply their handwritten signature 32 to any exterior surface of the soft sculpture 10 accessible to the writing implement 25. This process may be accomplished by circulating the soft sculpture 10 to interested participants.

The sculpture 10 with the handwritten signatures of the participants may thereafter be delivered to the recipient and is intended to lift the recipient in a spiritual manner. The soft sculpture 10 is designed to provide tangible evidence of the intercessory prayers being offered on behalf of the recipient by their friends and/or family.

From the above it can be seen that the method of the present invention provides tangible evidence of the intercessory prayers being offered on behalf of the recipient by friends and family members who pledge to remember they recipient in their personal prayers.

The soft sculpture used in performing the present invention is fabricated from materials suitable for the application of handwritten signatures by a standard writing implement such as an ink pen or permanent marker which is provided with the soft sculpture.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of providing tangible evidence of the recitation of intercessory prayer pledges on behalf of a recipient, said method comprising the steps of fabricating a soft sculpture having a body portion including an exterior surface suitable for the application of handwritten messages and signatures;

attaching a writing implement means to said soft sculpture by the use of a predetermined length of ribbon;

securing a placard bearing an introduction and description of said soft sculpture and a prayer inscription about said body portion of said sculpture;

writing a plurality of said messages and said signatures onto said soft sculpture; and delivering said soft sculpture bearing said messages and said signatures to said recipient.

* * * * *